US008220083B2

(12) United States Patent
Strickland

(10) Patent No.: US 8,220,083 B2
(45) Date of Patent: Jul. 17, 2012

(54) MOUNTING APPARATUS FOR BATH FITTING

(75) Inventor: Timothy Vaughan Strickland, Auckland (NZ)

(73) Assignee: Markon Holdings Limited, Auckland (NZ)

( * ) Notice: Subject to any disclaimer, the term of this patent is extended or adjusted under 35 U.S.C. 154(b) by 382 days.

(21) Appl. No.: 12/516,324

(22) PCT Filed: Nov. 26, 2007

(86) PCT No.: PCT/NZ2007/000348

§ 371 (c)(1),
(2), (4) Date: Sep. 18, 2009

(87) PCT Pub. No.: WO2008/063090

PCT Pub. Date: May 29, 2008

(65) Prior Publication Data

US 2010/0064429 A1 Mar. 18, 2010

(30) Foreign Application Priority Data

Nov. 24, 2006 (NZ) ..... 551615
Dec. 4, 2006 (NZ) ..... 551825

(51) Int. Cl.
*A61H 33/04* (2006.01)

(52) U.S. Cl. ..... 4/541.6

(58) Field of Classification Search ..... 4/541.1, 4/541.6, 538

See application file for complete search history.

(56) References Cited

U.S. PATENT DOCUMENTS

| | | | | |
|---|---|---|---|---|
| 2,896,222 | A * | 7/1959 | Freibott | 4/675 |
| 4,349,923 | A * | 9/1982 | Chalberg | 4/541.6 |
| 4,813,086 | A * | 3/1989 | Henkin et al. | 4/541.6 |
| 4,965,893 | A * | 10/1990 | Henkin et al. | 4/541.4 |
| 5,054,474 | A * | 10/1991 | Jacob et al. | 601/160 |
| 5,076,319 | A * | 12/1991 | Salley | 137/360 |
| 5,083,328 | A * | 1/1992 | Toson | 4/541.6 |
| 5,381,831 | A * | 1/1995 | Versland | 137/868 |
| 5,526,540 | A * | 6/1996 | Johnson | 4/541.6 |
| 5,813,431 | A * | 9/1998 | Cool et al. | 137/360 |
| 5,937,450 | A * | 8/1999 | Jones | 4/252.1 |
| 6,052,844 | A * | 4/2000 | Walsh et al. | 4/541.1 |
| 6,105,182 | A * | 8/2000 | Elnar | 4/541.1 |
| 6,138,290 | A * | 10/2000 | Lin | 4/295 |
| 6,334,463 | B1 * | 1/2002 | Lee | 137/801 |
| 7,127,751 | B2 * | 10/2006 | Lebrun et al. | 4/541.6 |
| 2003/0208841 | A1 * | 11/2003 | Marks | 4/541.6 |
| 2004/0025249 | A1 * | 2/2004 | Berry et al. | 4/695 |
| 2004/0168249 | A1 * | 9/2004 | Gerth et al. | 4/541.6 |
| 2006/0010595 | A1 * | 1/2006 | Ismert et al. | 4/675 |
| 2006/0225199 | A1 * | 10/2006 | Hatrick-Smith et al. | 4/541.6 |
| 2007/0226893 | A1 * | 10/2007 | Edris | 4/541.6 |
| 2007/0251001 | A1 * | 11/2007 | Hatrick-Smith et al. | 4/541.3 |
| 2009/0139020 | A1 * | 6/2009 | Faulstich | 4/541.6 |

OTHER PUBLICATIONS

International Search Report PCT/NZ2007/000348, Mar. 7, 2008.

* cited by examiner

*Primary Examiner* — Lori Baker
(74) *Attorney, Agent, or Firm* — Young & Thompson

(57) ABSTRACT

Bath fitting mounting apparatus has a wall contacting flange (16) and a fitting support portion (3) which enables a wall mounted bath fitting (18) to be mounted in a wall (1) of a bathing installation such that the fitting is substantially flush with the wall.

20 Claims, 6 Drawing Sheets

MOUNTING APPARATUS FOR BATH FITTING

This invention relates to a mounting apparatus for mounting a bath or shower fitting in a wall of a bath or shower installation. The invention is directed particularly, but not solely, to the mounting of spa fittings such as spa jets, suction fittings and control apparatus in a wall (including a base wall) of a bath such as a spa pool or spa bath.

BACKGROUND TO THE INVENTION

Many bath fittings such as spa jets, air buttons, suction fittings etc need to be mounted such that they sit proud on the wall in which they are located i.e. they protrude from the wall. These protruding fittings can present an obstacle to comfortable and safe use of the bath installation. For example, protruding fittings can prevent a user from reclining against the wall in the vicinity of the fitting, and a user may suffer a graze or bruise from the protruding fitting when using the bath, for example when entering or exiting the bath. Fittings that protrude from the wall in which they are mounted can also be aesthetically displeasing.

One approach to reducing the extent to which such fittings protrude from the wall is to mould the wall or walls of the bath or shower installation with a recess at the intended location of each fitting. A hole is then drilled into the central portion of each recessed area, and the fitting is then mounted in the hole such that the outer surface of the fitting becomes flush with the bath wall. The down-side of such a design is that the moulded bath shell, for example, can only be used as a spa bath since the recesses look unusual or unattractive in an ordinary bath without the jets etc fitted. Furthermore, the location, type and number of fittings must be the same for each bathing installation which limits the choices available to users.

OBJECT OF THE INVENTION

It is an object to the present invention to overcome or at least to ameliorate one or more of the disadvantages of known constructions.

Alternatively, it is an object of the present invention to provide mounting apparatus for mounting a bath fitting in a wall of a bath or Shower installation which at least provides the public with a useful choice.

SUMMARY OF INVENTION

Accordingly in one aspect the invention consists in bath fitting mounting apparatus having a wall contacting flange, and a fitting engagement means dependent from the flange, the fitting support means being adapted to engage with a bath fitting.

In a further aspect the invention consists in a bath or shower fitting having a rear wall contacting shoulder and an engagement means capable of being moved relative to the rear wall contacting shoulder, the engagement means including a mounting shoulder, the rear wall contacting shoulder and the mounting shoulder being adjustably movable relative to each other, and mounting apparatus according to the preceding statement wherein the mounting shoulder is adapted to engage with the support portion.

In a further aspect the invention consists in a bathing installation having a fitting according to the preceding statement.

The invention also broadly consists of any parts of features described in this document, whether alone or in combination, and includes equivalents of all such parts or features where such equivalents have not been specifically set forth.

Further aspects of the invention will become apparent from the following description.

BRIEF DESCRIPTION OF THE FIGURES

Embodiments of the invention will be described by way of example with reference to the following drawings in which.

DESCRIPTION OF PREFERRED EMBODIMENTS

Figure 1:
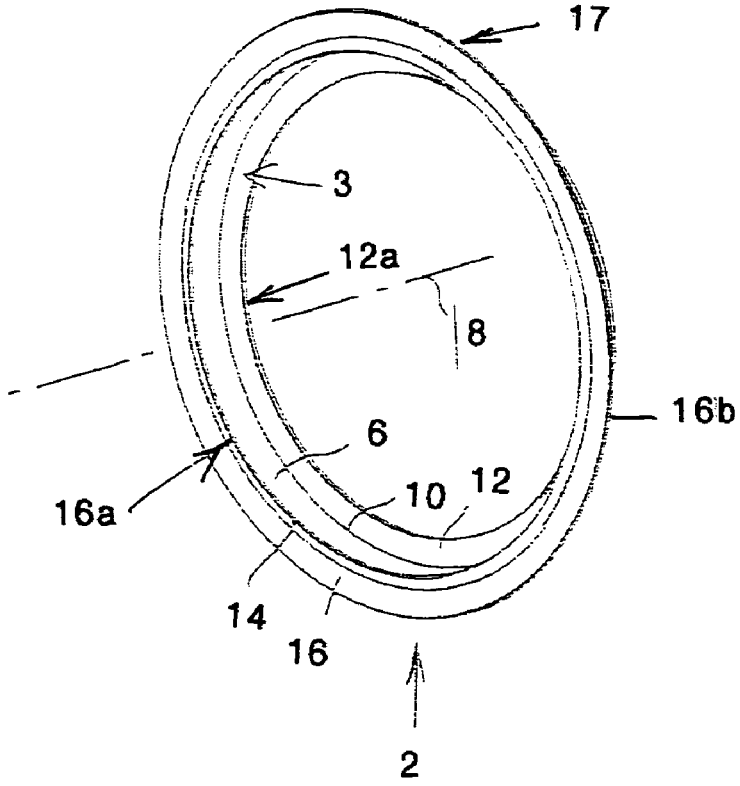
FIG. 1 Is an isometric view of one embodiment of mounting apparatus according to the invention.

Referring to the drawing figures, like reference numerals refer to the same or similar features between the various embodiments disclosed in this specification.

In FIG. 1, a first embodiment of bath fitting mounting apparatus 2 for mounting a wall mounted structure, such as a bath or shower fitting, in a wall of a bath or shower installation is shown generally in the form of an annular ring. Those skilled in the art will appreciate that references to a bath, or bath installation, or bathing installation in this document encompass showers and pools, and that references to walls of such installations includes walls that may be disposed horizontally or at other angles. The apparatus 2 in the embodiment of FIG. 1 includes a fitting engagement or support portion 3 having a wall 6 which is annular in this embodiment and generally parallel with a central axis 8. Support portion 3 engages with a fitting as will, be described further below. Support portion 3 in this embodiment also includes a fitting support flange 12 which is dependent from a first end 10 of wall 6 and defines an opening 12*a*. The fitting support flange 12 extends internally in a direction toward the axis 8. Wall 6 has a second end 14 from which a flange 16 which in use contacts a wall of the bathing installation in which the fitting is mounted extends in a direction away from axis 8 about an opening 16*a*, and has a periphery 16*b*. Both flanges 12 and 16 are, disposed in planes that are substantially normal (i.e. at 90°) to the axis 8. Flange 16 has a wall contacting surface 17 which contacts a front surface of a wall in which the fitting is mounted. The support portion 3 extends or protrudes from flange 16 on the side of the wall contacting surface 17 of that flange.

Furthermore, the flange 16 may be formed so that its periphery 16*b* is directed slightly toward the wall it is intended to contact. In this way a firm wall contact occurs in use and avoids possible injury should the periphery not be in contact with the wall. Flange 16, or the relevant part of the wall of the bathing installation may include a sealing gasket or membrane (not shown) that is located in use between the flange 16 and the wall.

Figure 1A:
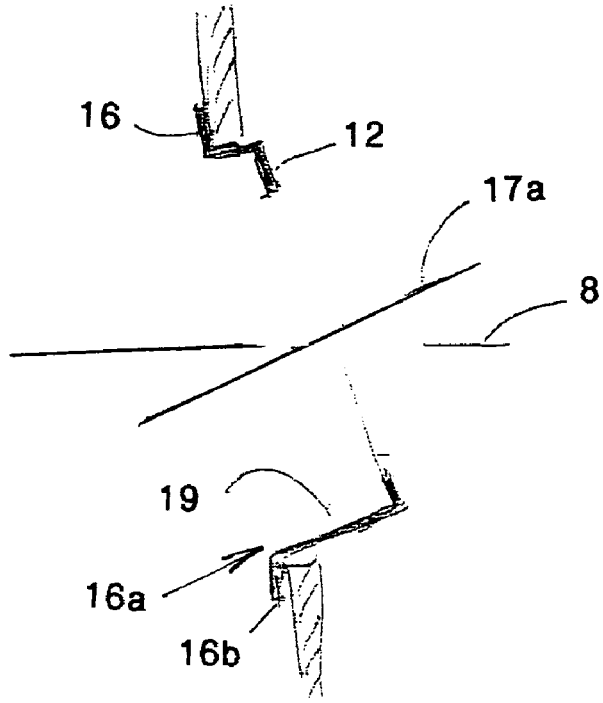
FIG. 1*a* Is a cross-sectional view of the embodiment shown in FIG. 1 but with the axis of the aperture displaced angularly relative to the axis of the wall contacting flange.

Referring to FIG. 1*a,* another embodiment is shown in cross section. In the embodiment of FIG. 1*a* the fitting support flange 12 has its axis 17 offset relative to the central axis 8 of the wall contacting flange 16, thus creating a frustum or conical fitting support portion 19. In such an embodiment the bath fitting could be set back at an angle from the bath wall.

Figure 2:
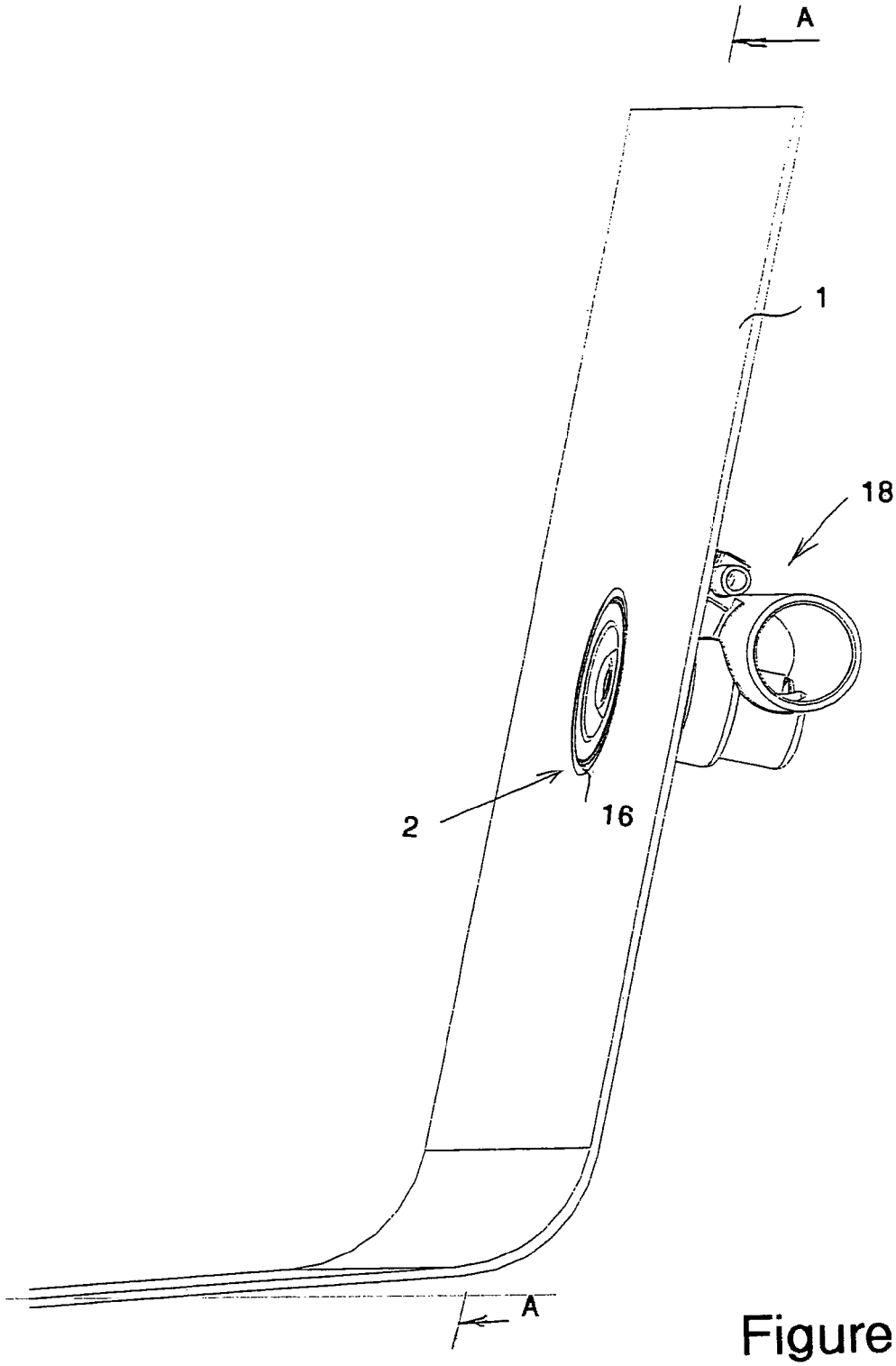
FIG. 2 Is an isometric view of part of a bath wall showing a spa jet mounted in the wall using the apparatus of FIG. 1.

Referring to FIG. 2, the mounting apparatus 2 according to the embodiment of FIG. 1 is shown in use for mounting a bath or shower fitting such as a spa bath jet fitting which is generally referenced 18 in a wall 1 of a bath (only partially shown). As can be seen from FIG. 2, the fitting is substantially flush with a front surface of the bath wall 1.

Figure 3:
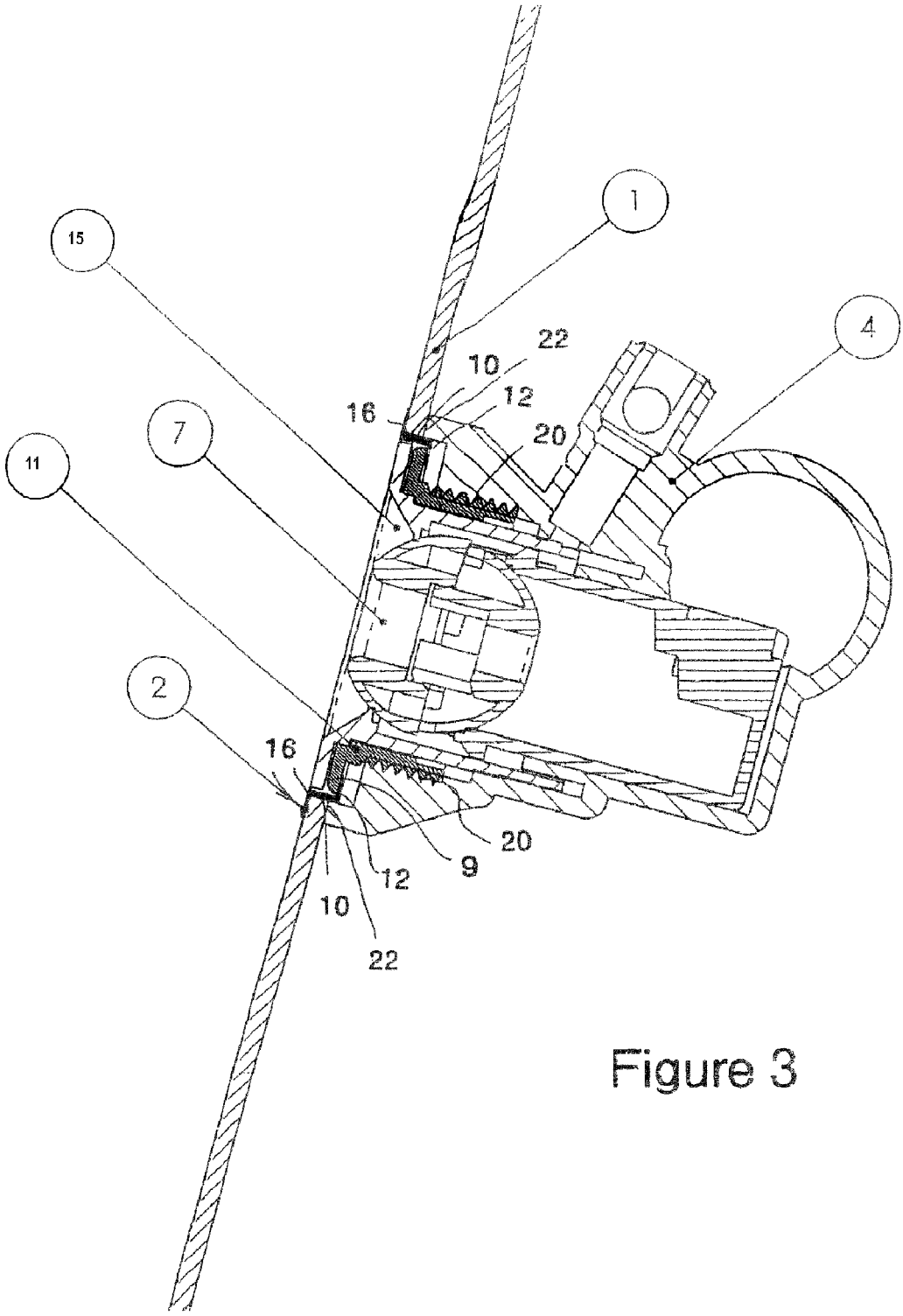
FIG. 3 Is a cross-section through line AA of FIG. 2.
Figure 4C:
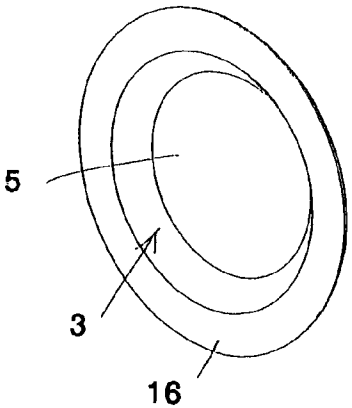
FIG. 4*c* Is an isometric front view of the apparatus of FIG. 4*a*.
Figure 4D:
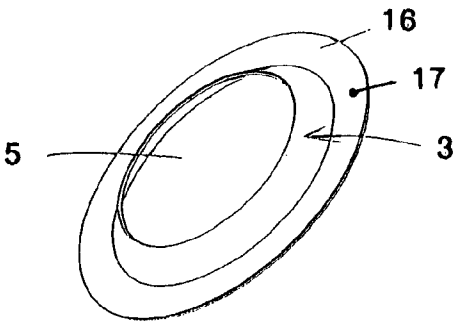
FIG. 4*d* Is an isometric rear view of the apparatus of FIG. 4*a*.
Figure 4A:
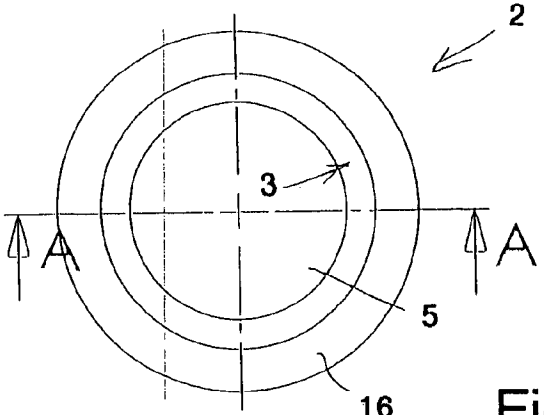
FIG. 4*a* Is a front elevation of a second embodiment.
Figure 4B:
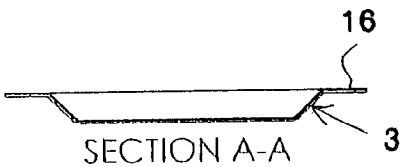
FIG. 4*b* Is an end elevation in cross section through line AA of FIG. 4*a*.

In FIG. 3, the construction shown in FIG. 2 is illustrated in cross-section. Referring to FIG. 3, the fitting 18 includes a body 4, a mounting nut 11 which includes a shoulder 9 and a nozzle retainer member 15 for retaining an eyeball of the nozzle member 7.

In use, the body 4 may be provided at the internal or rear surface of the wall 1 located adjacent to an aperture in the wall. The mounting member 2 is placed in the aperture such that the annular wall 6 sits adjacent to the edges of the aperture in the wall 1. The nut 11 is then screwed into the body 4 via co-operating threaded regions 20 on the body and the nut, such that mounting shoulder 9 of the nut engages with a surface of flange 12. The surface of flange 12 with which engagement of shoulder 9 occurs is the surface nearest to the flange 16. The nut is progressively tightened until such time as wall contacting shoulder 22 of the body 4 contacts the rear surface of wall 1 so that the body 4 is securely mounted relative to the wall 1 as shown in FIG. 3. The user may then insert the nozzle member 7 and the nozzle retainer member 15 to complete the installation. As can be seen from FIG. 3, the installation is substantially flush with the front surface of the wall 1.

The bath fitting wall mounting apparatus 2 is preferably constructed of a metal such as stainless steel, and provides an aesthetically pleasing flush appearance to the mounted fitting while being inexpensive to manufacture and simple to use. The apparatus 2 can be manufactured from 0.5 mm thick sheet metal. Other materials may be used but a thin flange 16 is preferred to allow the fitting to be mounted in such a way that is it substantially flush with the surrounding wall.

Referring now to the embodiment of FIGS. 4*a* to 4*d*, like reference numerals refer to like features between this embodiment and the other embodiments disclosed in the specification. The support portion 3 defines aperture 5 and is dependent from the wall contacting flange 16. In use, the embodiment shown in FIGS. 4*a* to 4*d* can be used with a nut 11 which has a conical surface on shoulder 9 to engage with a wall of the frustum formed by the support portion 3 in this embodiment.

Figure 5C:
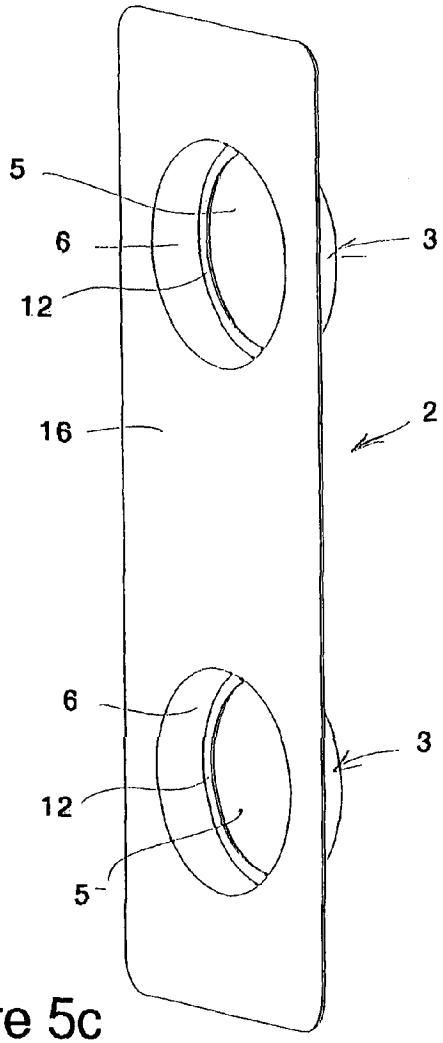
FIG. 5*c* Is an isometric front view of FIG. 5*a*.
Figure 5A:
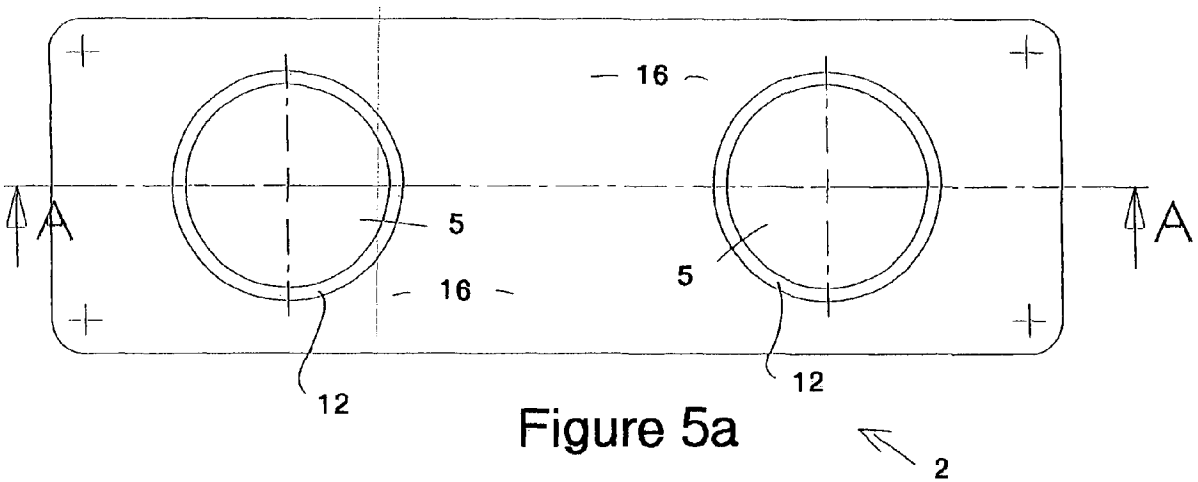
FIG. 5*a* Is a front elevation of a third embodiment of the invention
Figure 5B:
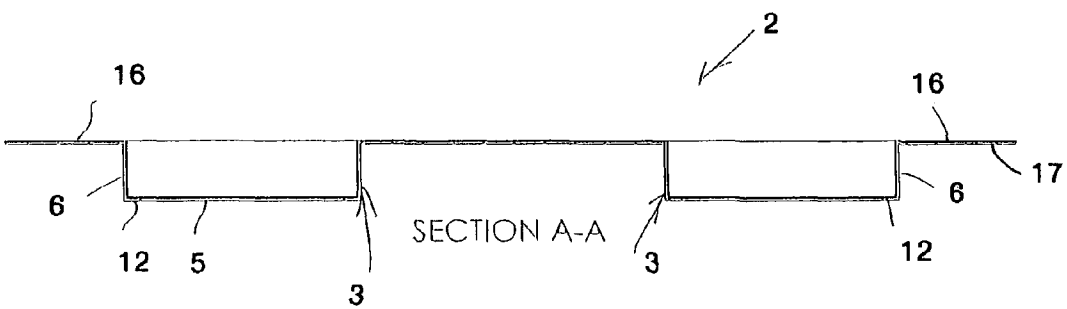
FIG. 5*b* Is an end elevation in cross section through line AA of FIG. 5*a*.

Turning now to the embodiment of FIGS. 5*a* to 5*c*, the flange 16 in this embodiment is attached to or constructed to include the flange of a further fitting. The result is that a single unitary item may be used to install two bath fittings. Those skilled in the art will appreciate that other arrangements may be provided such that more than 2 mounting members may be combined into a single article so that multiple fittings may be mounted using the same article.

Referring now to FIGS. 6*a* to 6*d*, yet another embodiment is shown. In this embodiment the mounting member 2 has a square shape rather than a circular shape. To allow a fitting to be mounted relative to a wall, a retainer head member 30 contacts flange 12 and a centre retainer 32, which may comprise nut 3 of FIG. 3 for example, is received within the retainer head 30.

Figure 7:
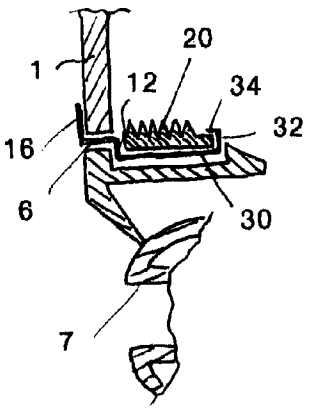
FIG. 7 Is a partial side elevation in cross section illustrating another embodiment of the invention in use mounting a spa jet fitting.
Figure 6C:
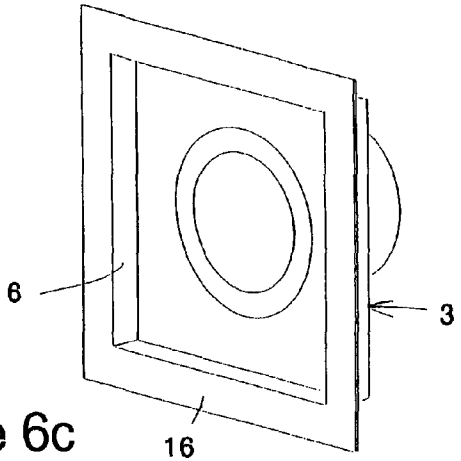
FIG. 6*c* Is an isometric front view of FIG. 6*a*.
Figure 6D:
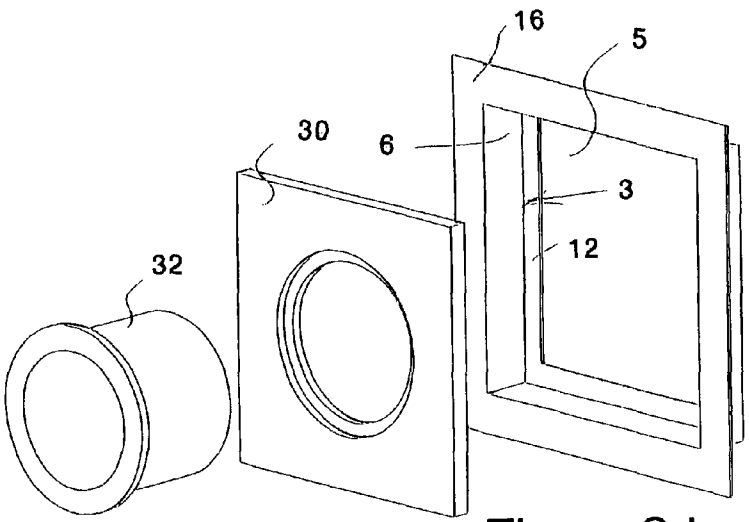
FIG. 6*d* Is an exploded view of FIG. 6*c*.
Figure 6A:
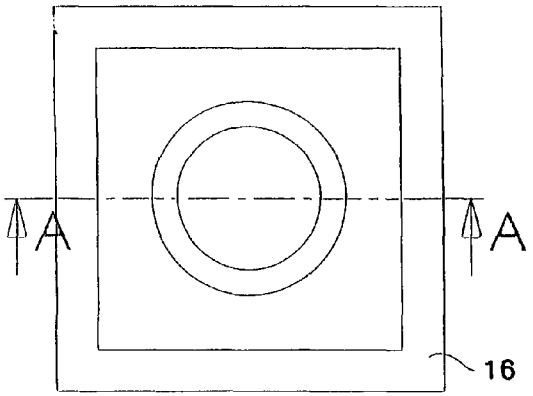
FIG. 6*a* Is a front elevation of a fourth embodiment of the invention.
Figure 6B:
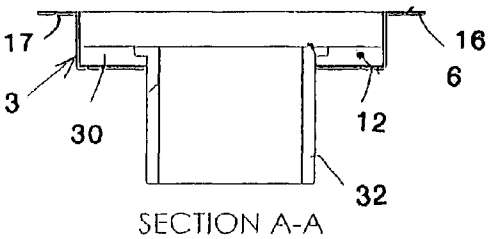
FIG. 6*b* Is an end elevation in cross section through line AA of FIG. 6*a*.

Referring to FIG. 7, another embodiment is shown in which support portion 3 includes a further wall 30 axial with axis 8, and a flange 32 at the distal end of wall 30. A lip 34 may be provided on the flange 32 such that the support portion engages with nut 11.

Those skilled in the art will appreciate that a wide variety of different wall mounted fittings may be mounted using the apparatus for example spa jets, suction fittings and air buttons. The apparatus allows fittings to be mounted in such a way that they are substantially flush with the surrounding wall surface in which they are mounted. Furthermore, the apparatus allows the fittings to be secured without requiring access from the rear side of the wall. In this manner the fittings can be secured and maintained from the front side of the wall.

The invention claimed is:

1. A bath or shower fitting assembly for installation in an aperture in a wall or bath or shower installation, the assembly comprising:

a) a mounting member having a flange including a front wall contacting surface, and a fitting support dependent from the flange, the fitting support being adapted to fit within the wall aperture; and b) the bath or shower fitting having a body, a rear wall contacting shoulder associated with the body to contact a rear surface of the wall of the bath or shower installation, a mounting shoulder associated with the body, the mounting shoulder having a fitting support contact surface to contact the fitting support of the mounting member, and the rear wall contacting shoulder and the mounting shoulder being adjustably movable relative to each other to engage a rear wall contacting surface with the rear surface of the wall of the bath or shower installation and to engage the fitting support contact surface of the mounting shoulder with the fitting support and to engage the fitting support and to engage the front wall contacting surface of the flange with a front surface of the wall of the bath or shower installation about the aperture to thereby engage the fitting in the wall aperture such that the fitting is substantially flush with the wall surrounding the flange.

2. The assembly as claimed in claim 1, wherein the fitting support defines an opening displaced from a plane of the flange.

3. The assembly as claimed in claim 1, wherein the fitting support includes a fitting support flange substantially parallel to the flange, and a wall between the fitting support flange and the flange.

4. The assembly as claimed in claim 1, wherein the fitting support comprises a frustum.

5. The assembly as claimed in claim 3, wherein the wall between the fitting support flange and the flange is substantially annular.

6. The assembly as claimed in claim 1, wherein the flange defines a first opening and the fitting support is dependent from the flange at or adjacent to the first opening.

7. The assembly as claimed claim 1, wherein the flange has an outer peripheral edge and the wall contacting surface is disposed adjacent to the outer peripheral edge.

8. The assembly as claimed in claim 1, wherein the flange is thin walled.

9. The assembly as claimed in claim 1, wherein the flange is manufactured from sheet metal.

10. The assembly as claimed in claim 9, wherein the sheet metal is substantially 0.5 mm in thickness.

11. A bathing installation comprising an assembly according to claim 1.

12. The assembly as claimed in claim 2, wherein the fitting support includes a fitting support flange substantially parallel to the flange, and a wall between the fitting support flange and the flange.

13. The assembly as claimed in claim 2, wherein the fitting support comprises a frustum.

14. A bath or shower fitting assembly for installation in an aperture in a wall or bath or shower installation, the assembly comprising:

a first flange configured for contacting the wall;

a second flange configured to support the bath or shower fitting, the first flange and the second flange being substantially normal to a central axis; and the bath or shower fitting, the bath or shower fitting being substantially flush with the wall surrounding the flanges, the bath or shower fitting comprising:

a body, a rear wall contacting shoulder associated with the body to contact a rear surface of the wall of the bath or shower installation, a mounting shoulder associated with the body, the mounting shoulder having a fitting support contact surface to contact a fitting support of a mounting member that includes the first and second flanges, and the rear wall contacting shoulder and the mounting shoulder being adjustably movable relative to each other to engage a rear wall contacting surface with the rear surface of the wall of the bath or shower installation and to engage the fitting support contact surface of the mounting shoulder with the fitting support and to engage the fitting support and to engage the front wall contacting surface of the flange with a front surface of the wall of the bath or shower installation about the aperture to thereby engage the fitting in the wall aperture.

15. The assembly as claimed in claim 14, wherein the fitting support defines an opening displaced from a plane of the flange.

16. The assembly as claimed in claim 14, wherein the fitting support comprises a frustum.

17. The assembly as claimed in claim 14, wherein the wall between the first and second flanges is substantially annular.

18. The assembly as claimed in claim 14, wherein the first flange defines an opening and the support portion is dependent from the flange at or adjacent to the opening.

19. The assembly as claimed claim 14, wherein the first flange has an outer peripheral edge and the wall contacting surface is disposed adjacent to the outer peripheral edge.

20. The assembly as claimed in claim 14, wherein the first flange is thin walled.

* * * * *

UNITED STATES PATENT AND TRADEMARK OFFICE

CERTIFICATE OF CORRECTION

PATENT NO. : 8,220,083 B2
APPLICATION NO. : 12/516324
DATED : July 17, 2012
INVENTOR(S) : Timothy Vaughan Strickland It is certified that error appears in the above-identified patent and that said Letters Patent is hereby corrected as shown below:

In the claims,

In claim 1, column 4, lines 49-50, delete
"and to engage the fitting support".

Signed and Sealed this
Twelfth Day of May, 2015

Michelle K. Lee

Michelle K. Lee
*Director of the United States Patent and Trademark Office*